US005737667A

United States Patent [19]

Okuda et al.

[11] Patent Number: 5,737,667

[45] Date of Patent: Apr. 7, 1998

[54] IMAGE FORMING APPARATUS HAVING A GRIPPER PORTION

[75] Inventors: Naoki Okuda, Kawasaki; Shohei Takeda, Yokohama, both of Japan

[73] Assignee: Canon Kabushiki Kaisha, Tokyo, Japan

[21] Appl. No.: 378,355

[22] Filed: Jan. 25, 1995

[30] Foreign Application Priority Data

Jan. 28, 1994 [JP] Japan ..... 6-008175

[51] Int. Cl.[6] ..... G03G 21/00

[52] U.S. Cl. ..... 399/108; 399/107

[58] Field of Search ..... 355/200; 347/108, 347/152, 170, 222, 263; 312/244, 902; 294/137; 220/696; 399/107, 108, 110, 411

[56] References Cited

U.S. PATENT DOCUMENTS

| | | | |
|---|---|---|---|
| 4,335,950 | 6/1982 | Gunzelmann et al. | 399/124 |
| 4,636,057 | 1/1987 | Iida et al. | 355/200 |
| 4,841,329 | 6/1989 | Kasamura et al. | 355/245 |
| 4,841,336 | 6/1989 | Kusumoto et al. | 355/245 |
| 4,922,300 | 5/1990 | Sasaki et al. | 355/245 |
| 4,969,010 | 11/1990 | Tamura et al. | 355/200 |

FOREIGN PATENT DOCUMENTS

| | | |
|---|---|---|
| 389365 | 4/1991 | Japan . |
| 389366 | 4/1991 | Japan . |
| 4-276765 | 10/1992 | Japan . |

*Primary Examiner*—Nestor R. Ramirez

*Attorney, Agent, or Firm*—Fitzpatrick, Cella, Harper & Scinto

[57] ABSTRACT

An image forming apparatus for forming an image on a recording medium, comprising a first frame, a second frame rotatable with respect to the first frame around a rotational center, and a gripper portion formed on the first frame at a position immediately below the hinge means, to be gripped for lifting and transmitting the image forming apparatus. The image forming apparatus can be made light weight and inexpensive, and stable transportation of the apparatus is ensured.

13 Claims, 7 Drawing Sheets

IMAGE FORMING APPARATUS HAVING A GRIPPER PORTION

BACKGROUND OF THE INVENTION

1. Field of the Invention

The present invention relates to an image forming apparatus such as a printer, a copying machine or the like.

2. Related Background Art

An example of an image forming apparatus wherein jam treatment and exchange of a cartridge can be effected by separating an upper frame and a lower frame from each other by relatively rocking the frames around a hinge portion positioned therebetween is disclosed in U.S. Pat. No. 4,335,950. It is also known to provide an image forming apparatus having a gripper portion which can be gripped by an operator to lift and transport the image forming apparatus.

Further, Japanese Patent Application Laid-open No. 3-89366 discloses a construction in which a space is formed between an upper frame and a lower frame in an inoperative condition of an image forming apparatus (for example, during the transportation of the apparatus). This patent also discloses the advantage that, by providing such a space, for example, even when a large shock is applied to the upper frame in a closing direction during the transportation of the image forming apparatus, elements (for example, a photosensitive drum and a charger) disposed in the image forming apparatus are not contactable with each other, thereby preventing damage to the elements.

SUMMARY OF THE INVENTION

An object of the present invention is to provide an image forming apparatus which is compact.

Another object of the present invention is to provide an image forming apparatus which is light-weight and inexpensive.

A further object of the present invention is to provide an image forming apparatus in which frames of the apparatus cannot be deformed during transportation of the apparatus.

An other object of the present invention is to provide an image forming apparatus in which a gripper portion for transporting the apparatus is arranged immediately below a hinge portion thereof.

DETAILED DESCRIPTION OF THE PREFERRED EMBODIMENTS

Figure 1:
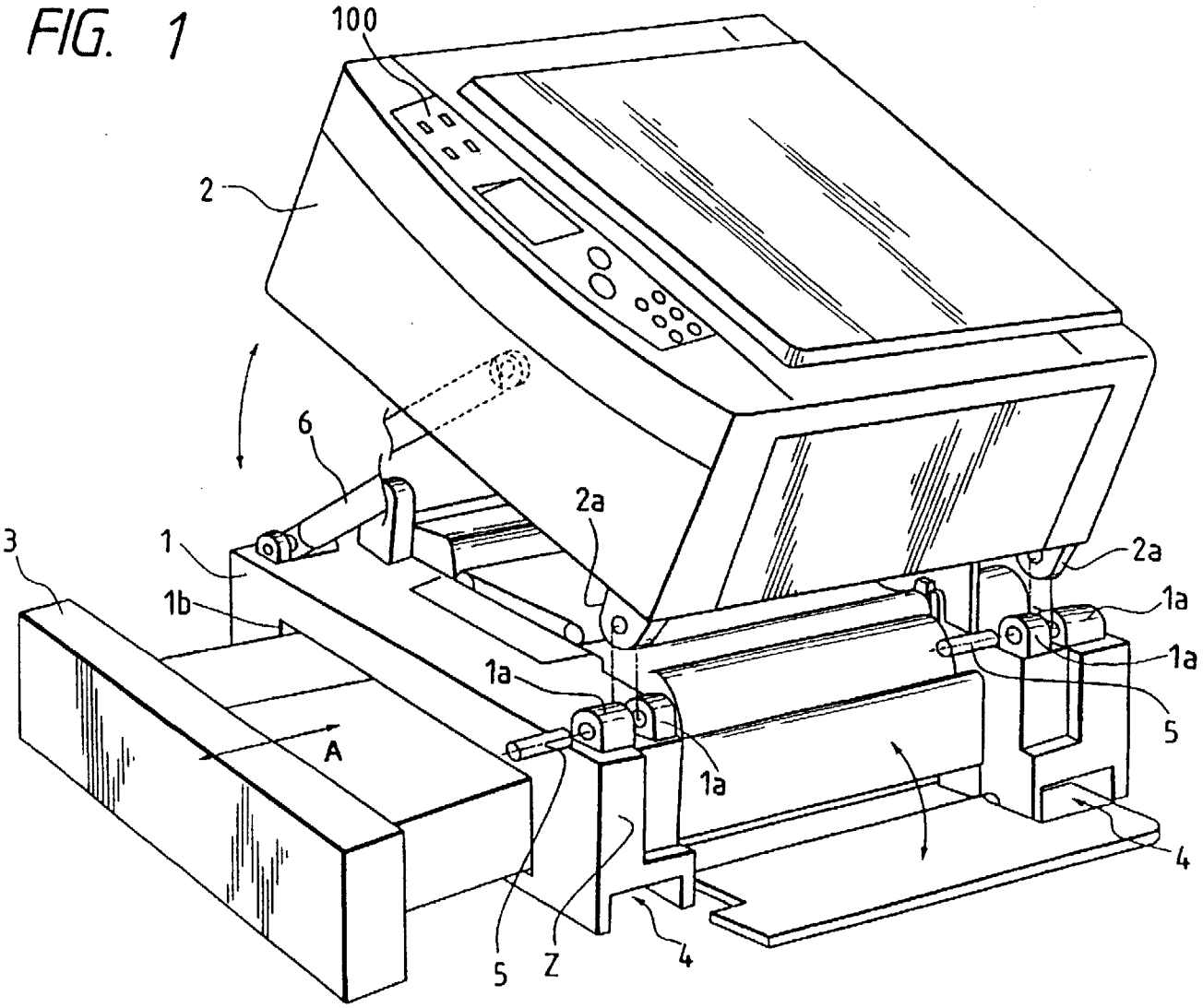
FIG. 1 is a perspective view of a copying machine to which an embodiment of the present invention is applied.

FIGS. 1 to 4, 5A, 5B and 5C show an embodiment of the present invention. This embodiment relates to an image forming apparatus comprising an upper frame 2, a lower frame 1, hinge portions 1*a*, 2*a* rotatably connecting the upper and lower frames 2, 1, and gripper portions 4 which can be gripped by an operator for transportation of the apparatus. In this image forming apparatus, the gripper portions 4 are arranged immediately below the hinge portions 1*a*, 2*a*. Further, the hinge portions 1*a* of the lower frame 1 are integrally formed with the corresponding gripper portions 4 with the same material. In addition, the lower frame 1 is provided with a cassette containing portion 1*b* for containing a cassette 3.

According to this embodiment, with the arrangement as mentioned above, since the upper and lower frames 1, 2 are rotatably connected to each other through the hinge portions 1*a*, 2*a*, by relatively rocking the frames to separate them from each other, jam treatment and exchange of a cartridge can easily be effected. Further, the rigidity of the frames is increased, and the entire frame can be made compact. In addition, since the gripper portions 4 of the lower frame 1 for transportation of the apparatus are arranged immediately below the hinge portions 1*a*, 2*a*, even when the apparatus is lifted up, deformation of the frames can be prevented.

FIG. 1 is a perspective view of a copying machine to which the above-mentioned embodiment is applied. The copying machine includes the lower frame 1 and the upper frame 2. The lower and upper frames 1, 2 are connected to each other via the hinge portions 1*a*, 2*a*. A gas damper 6 serves to keep the frames 1, 2 in an opened condition. As mentioned above, the lower frame 1 is provided with the cassette containing portion 1*b* for containing the cassette 3.

Figure 2:
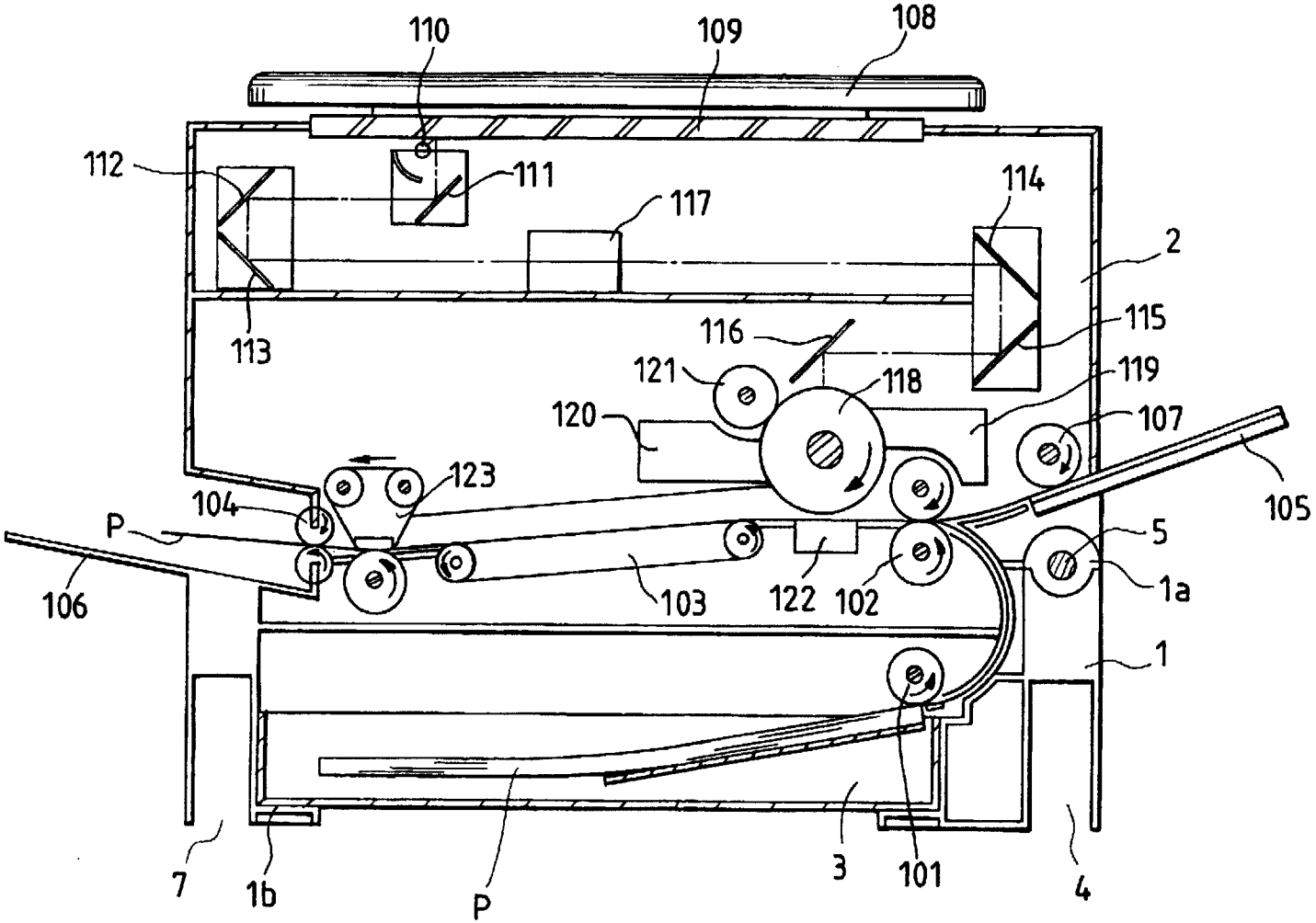
FIG. 2 is a sectional view of the copying machine of FIG. 1, showing the condition wherein upper and lower frames are closed relative to each other.
Figure 3:
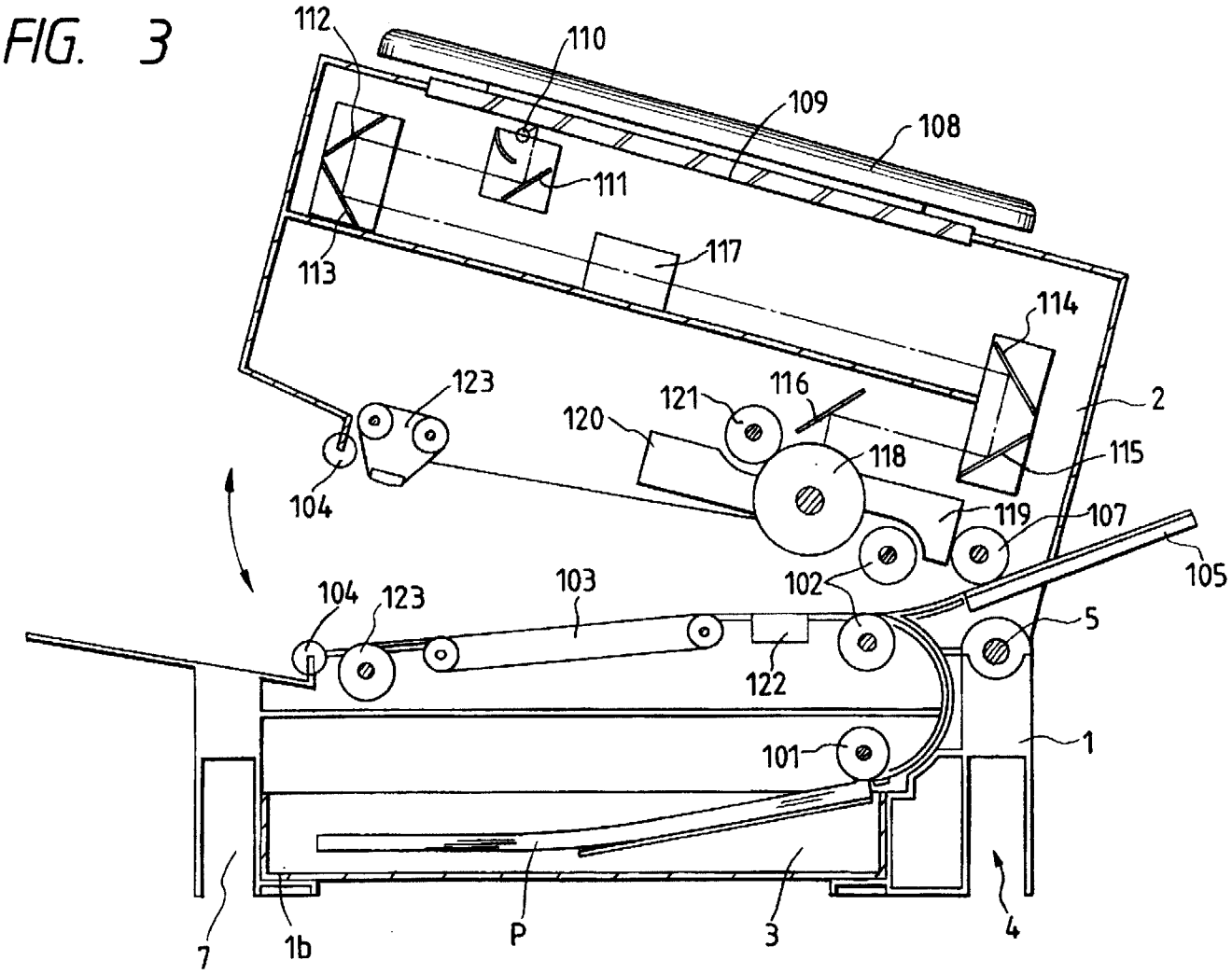
FIG. 3 is a sectional view of the copying machine of FIG. 1, showing the condition wherein the upper and lower frames are separated from each other.
Figure 4:
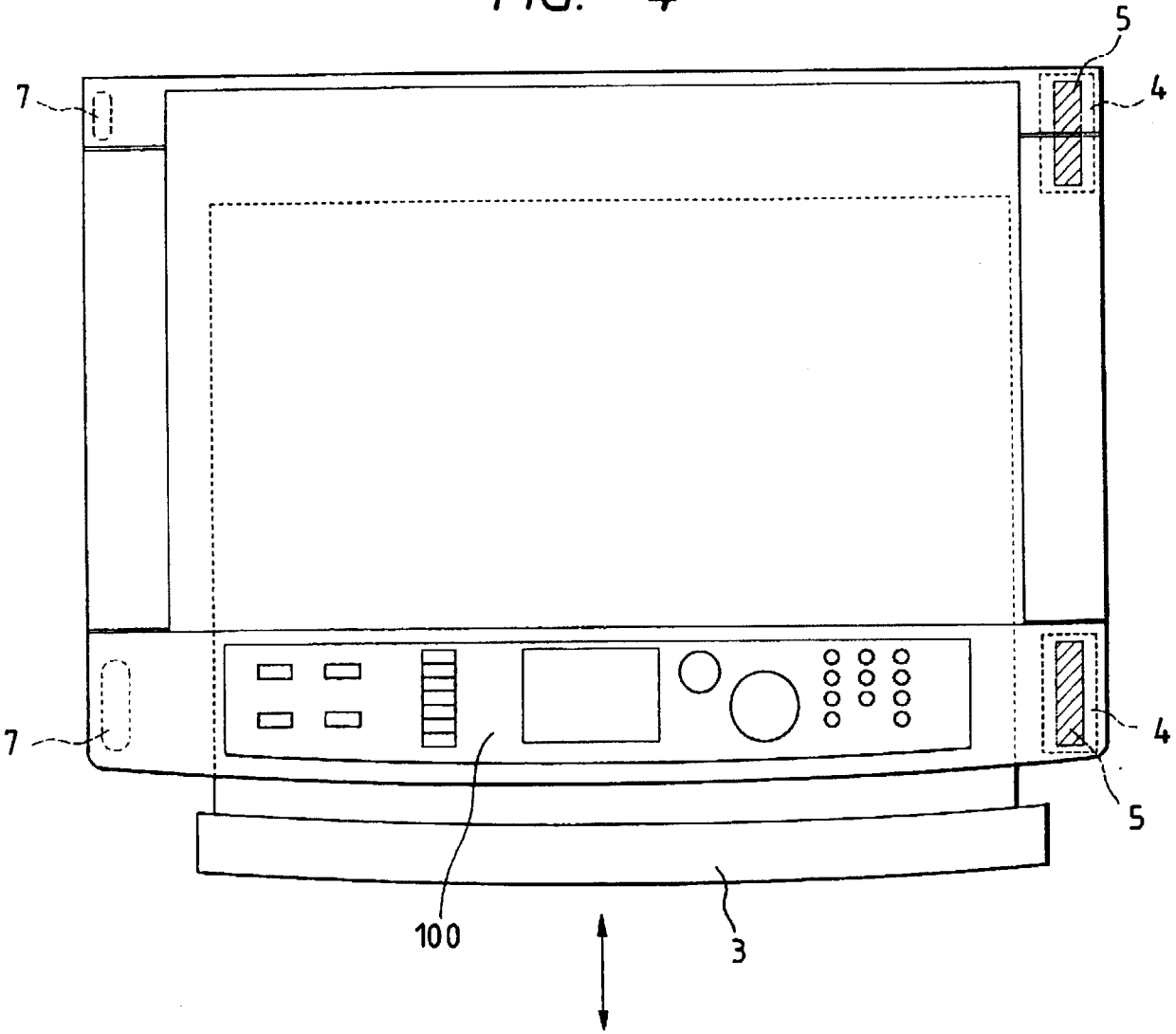
FIG. 4 is a plan view of the copying machine of FIG. 1.

FIGS. 2 and 3 are sectional views of the copying machine, where FIG. 2 shows the condition that the frames 1, 2 are closed respect to each other and FIG. 3 shows the condition that the frames are opened or separated from each other. Incidentally, FIG. 4 is a plan view of the copying machine, showing the condition that the cassette 3 is partially extracted from the containing portion 1*b*.

As shown in FIGS. 1 to 4, in this embodiment, the gripper portions 4 are arranged immediately below the hinge portions 1*a*. When the copying machine is to be transported, an operator, grips gripper portion 4 and gripper portion 7 (FIG. 3) with respective hands to lift the machine and transport the machine to a desired location. Incidentally, as is apparent from FIG. 3, the gripper portions 4, 7 are constituted by recessed portions to permit the easy gripping of the machine. That is to say, the gripper portions 4 are disposed at front and rear positions on one side of the cassette containing portion 1*b* in a cassette mounting/dismounting direction shown by the arrow A (FIG. 1), and the gripper portions 7 are disposed at front and rear positions on the other side of the cassette containing portion 1*b*. Incidentally, the gripper portions 7 are not arranged immediately below the hinge portions 1*a*. Thus, when the copying machine is transported, the operator grips one of the gripper portions 4 one hand and grips one of the gripper portions 7 with his other hand to lift and transport the machine. More particularly, the operator grips the gripper portion 4 arranged immediately below the hinge portion 1*a* with one hand and grips the gripper portion 7 offset from the hinge portion 1*a* with his other hand to lift and transport the machine.

Figure 7:
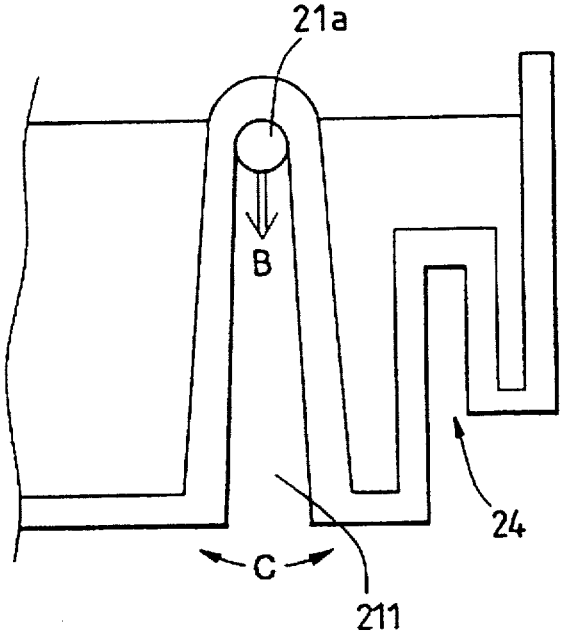
FIG. 7 is a comparison view for explaining an advantage of the present invention.

As shown in FIG. 7, if a gripper portion 24 is offset from a hinge portion 21*a* (not immediately below the hinge portion), when a copying machine is lifted up with an upper frame 2 kept in an opened condition, almost all of the weight of the upper frame acts on the hinge portions 21*a*. In this case, however, since the gripper portion 24 is offset from the position where the weight of the upper frame is applied, the copying machine will be unstable during the transportation thereof.

Further, as shown in FIG. 7, when the hinge portion 21*a* and the gripper portion 24 are integrally formed with each other by using upper and lower mold halves, it is necessary to form a material removing opening 211 below the hinge portion 21*a* in consideration of the design of the mold. Thus, when the gripper portion 24 is arranged offset from the hinge portion 21*a*, as shown in FIG. 7, the gripper portion and the hinge portion must be formed with substantial widths, respectively, thereby making the copying machine bulky.

Further, when the copying machine is lifted via the gripper portions 24 in the condition where the upper frame 2 is opened, i.e. in the condition that the weight of the upper frame acts on the hinge portions 21*a*, the lower frame is deformed in a direction shown by an arrow C, thereby making the copying machine unstable during the transportation of the machine. Thus, the thickness of the frame cannot be reduced, thereby preventing the machine from being light-weight and inexpensive.

To the contrary, according to the illustrated embodiment, by arranging the gripper portions 4 (one of which is gripped by the operator during the transportation of the copying machine) immediately below the corresponding hinge portions 1*a*, even when the copying machine is lifted in a condition wherein the upper frame 2 is opened, since the operator supports the machine at the position immediately below the hinge portion 1*a* to which the weight of the upper frame 2 is applied, the copying machine can be transported stably.

Figure 5A:
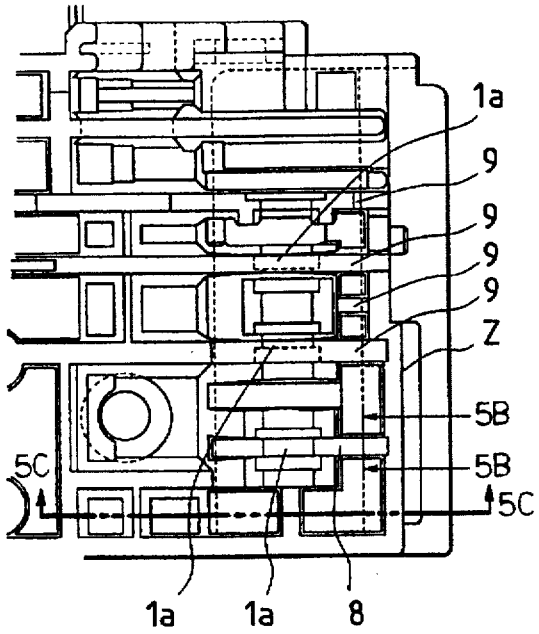
FIG. 5A is a view showing reinforcing ribs.
Figure 5C:
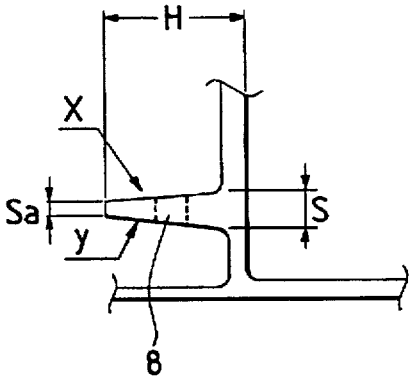
FIG. 5C is a sectional view taken along the line 5C—5C in FIG. 5A.
Figure 5B:
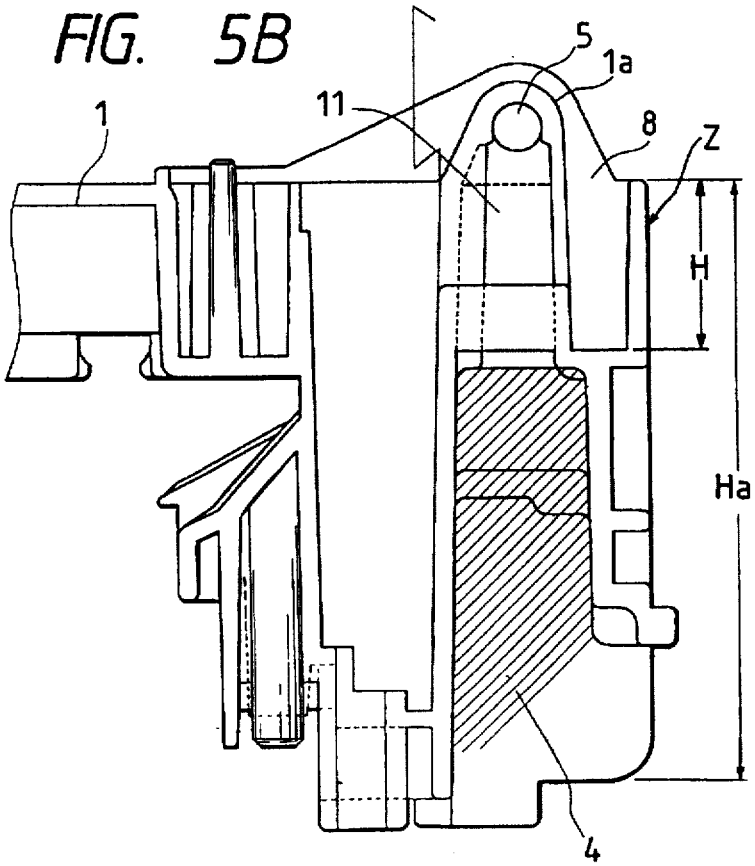
FIG. 5B is a sectional view taken along the line 5B—5B in FIG. 5A

Furthermore, in the illustrated embodiment, as shown in FIGS. 5A to 5C, since the hinge portions 1*a* of the lower frame 1 are integrally formed with the gripper portions 4 with the same material, the number of parts can be reduced, thereby making the copying machine Cheaper. In addition, since the gripper portions 4 are arranged immediately below the corresponding hinge portions 1*a*, the copying machine can be made compact and the stability of the machine can be ensured during the lifting and transportation of the machine.

That is to say, as shown in FIG. 4, when the lower frame 1 is provided with a cassette containing portion for containing the recording material cassette 3, although the gripper portions 4 must be disposed on both sides of the recording material cassette 3, since the gripper portions are arranged immediately below the corresponding hinge portions, the copying machine can be made compact in comparison with a copying machine wherein the gripper portions are offset from corresponding hinge portions. Further, when the copying machine is lifted in a condition wherein the upper frame 2 is opened, since the copying machine is supported by the operator via the gripper portion 4 arranged immediately below the hinge portion 1*a* to which the weight of the upper frame 2 is applied, deformation of the frame can be prevented, thereby lifting and transporting the copying machine stably. Further, since deformation of the frame can be prevented, the wall thickness of the frame can be reduced, thereby making the copying machine light weight and inexpensive.

Further, when the gripper portions 4 are integrally formed with the hinge portions 1*a* with the same material as mentioned above, as shown in FIG. 5B, it is necessary to form a material removing opening 11 below the hinge portion 1*a* in consideration of the design of the mold. However, according to the illustrated embodiment, since the gripper portion 4 is located immediately below the hinge portion, the material removing opening 11 can be minimized, and, thus, the strength of the frame is not reduced. Further, since the mold for forming the frame has less complexity, the strength of the mold can be increased.

In this manner, according to the illustrated embodiment, as shown in FIG. 5A, which is a plan view of the lower frame 1, the hinge portion 1*a* is provided with reinforcing ribs 8, 9 to reinforce the hinge portion 1*a* so that the hinge portion is not deformed by the weight of the upper frame 2. Incidentally, since the hinge portions 1*a* are disposed near an outside of the body of the copying machine, the reinforcing ribs 8, 9 reach an outer surface Z of the machine body. As shown in FIG. 5C, regarding the reinforcing rib 8, it is necessary to form inclination surfaces x, y in order to remove the mold from the reinforcing rib after the molding operation. Thus, if a height H of the reinforcing rib is great, a width S of a root of the rib will also become great, thereby increasing the volume of the root of the reinforcing rib. As a result, in the frame molding operation, after the mold is removed from the rib, the contraction amount of the reinforcing rib is increased, thereby generating recesses in the root of the reinforcing rib, which recesses also appear on the outer surface Z of the machine body. This phenomenon is called a "wrinkle". Accordingly, if the height of the reinforcing rib is great, as shown by Ha, a width Sa of the top of the reinforcing rib must be small in order to prevent the occurrence of wrinkle. However, in the illustrated embodiment, since the gripper portion 4 is arranged immediately below the hinge portion 1*a*, the height of the reinforcing rib becomes H, smaller than Ha, with the result that the occurrence of a wrinkle at the outer surface Z can be pevented without reducing of the top width Sa of the reinforcing rib 8. Further, since it is possible to increase the top width Sa of the reinforcing rib 8, the strength of the side surfaces of the reinforcing rib can be increased.

Incidentally, in FIGS. 1 and 4, the reference numeral 100 denotes a control panel Qn which a copy start button, copy number setting buttons, a density setting button and the like are arranged. Further, in FIGS. 2 and 3, the recording medium is designated by P. Further, the reference numeral 101 denotes a supply roller; 102 denotes registration rollers; 103 denotes a convey belt; 104 denotes discharge rollers; 105 denotes a manual insertion tray; 106 denotes a discharge tray; 107 denotes a feed roller; 108 denotes an original cover; 109 denotes a platen glass; 110 denotes a lamp; 111–116 denote mirrors; 117 denotes a lens; 118 denotes an electrophotographic photosensitive drum; 119 denotes a developing means; 120 denotes a cleaning means; 121 denotes a charge roller; 122 denotes a transfer means; and 123 denotes a fixing means.

Next, another embodiment of the present invention will be explained with reference to FIGS. 6A and 6B.

Figure 6A:
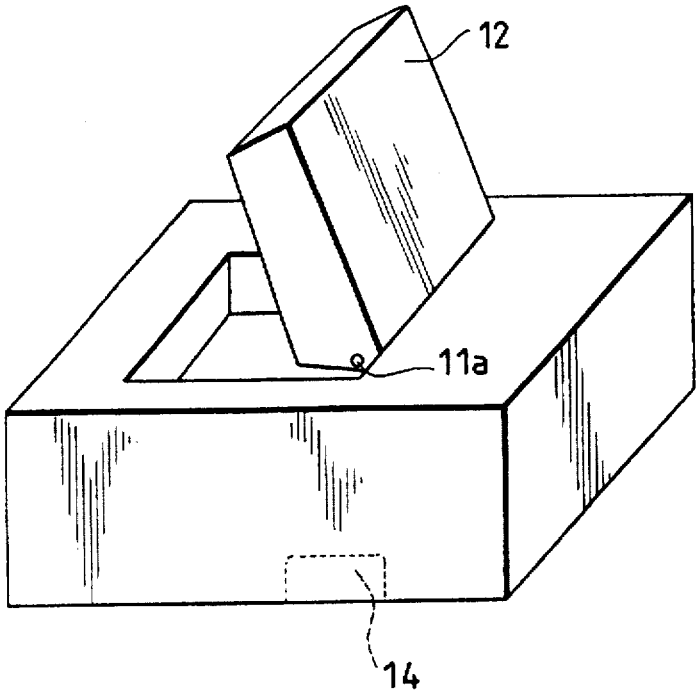
FIG. 6A is a perspective view of a copying machine according to another embodiment of the present invention.
Figure 6B:
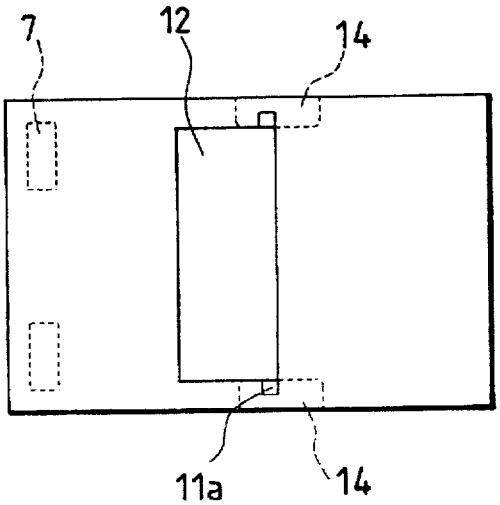
FIG. 6B is a plan view of the copying machine of FIG. 6A.

Also in an image forming apparatus wherein an opening/closing lid 12 is provided at a central portion of a top surface of the apparatus as shown in FIGS. 6A to 6B, by arranging gripper portions 14 immediately below corresponding hinge portions 11*a*, as shown in FIGS. 6A and 6B, as is in the aforementioned embodiment, it is possible to prevent deformation of the frame and to make the frame light-weight and inexpensive.

According to the above-mentioned embodiments, since the gripper portions for lifting and transporting the image forming apparatus are arranged immediately below the hinge portions, even when the image forming apparatus is lifted and transported in a condition wherein the upper frame is opened, deformation of the lower frame can be prevented. Accordingly, the wall thickness of the lower frame can be reduced, thereby making the image forming apparatus light-weight and inexpensive.

As mentioned above, according to the present invention, the entire image forming apparatus can be made compact and light-weight.

What is claimed is:

1. An image forming apparatus for forming an image on a recording medium, comprising:

a first frame;

a second frame pivotable with respect to said first frame around a pivotal shaft located between said first and second frames along one side edge of said first and second frames; and a first gripper portion formed on a surface of said first frame opposite to a surface where the pivotal shaft is located at a position immediately below the pivotal shaft for facilitating lifting and transporting said image forming apparatus.

2. An image forming apparatus according to claim 1, wherein said first frame comprises a hinge portion contacting the pivotal shaft, said hinge portion being integrally formed with said first gripper portion.

3. An image forming apparatus according to claim 2, wherein said hinge portion is provided with a reinforcing rib.

4. An image forming apparatus according to claim 2, wherein said first frame further includes a containing portion for containing a supply cassette supporting recording thereon, and wherein said first gripper portion is disposed at a front end and a rear end of said first frame with respect to a mounting/dismounting direction of the supply cassette.

5. An image forming apparatus according to claim 4, wherein said first gripping portion is disposed on said first frame along said one side edge thereof, wherein said apparatus further comprises a second gripper portion disposed on said first frame along the other side edge thereof offset from said first gripper portion along said one side edge of said first frame, at a front end and a rear end of said first frame with respect to the cassette mounting/dismounting direction.

6. An image forming apparatus according to claim 5, wherein said first and second gripper portions of the front and rear ends of the one and other side edges are recessed portions.

7. An image forming apparatus according to claim 6, wherein said second frame is kept in an opened condition with respect to said first frame by damper means.

8. An image forming apparatus for forming an image on a recording medium, comprising:

a first frame;

a second frame pivotable with respect to said first frame around a pivotal shaft located between said first and second frames;

a first gripper portion formed on said first frame at a position immediately below the pivotal shaft for facilitating lifting and transporting said image forming apparatus; and a hinge portion formed on said first frame integrally with said first gripper portion.

9. An image forming apparatus according to claim 8, wherein said hinge portion is provided with a reinforcing rib.

10. An image forming apparatus according to claim 9, wherein said first frame further includes a containing portion for containing a supply cassette supporting recording thereon, and wherein said first gripper portion is disposed at a front end and a rear end of said first frame with respect to a mounting/dismounting direction of the supply cassette, along one side edge of said first frame.

11. An image forming apparatus according to claim 10, further comprising a second gripper portion disposed on said first frame along the other side edge thereof offset from said first gripper portion along said one side edge of said first frame at a front end and a rear end of said first frame with respect to the cassette mounting/dismounting direction.

12. An image forming apparatus according to claim 11, wherein said first and second gripper portions of the front and rear ends of the one and other side edges are recessed portions.

13. An image forming apparatus according to claim 12, wherein said second frame is kept in an opened condition with respect to said first frame by damper means.

* * * * *

UNITED STATES PATENT AND TRADEMARK OFFICE

CERTIFICATE OF CORRECTION

PATENT NO. : 5,737,667

DATED : April 7, 1998

INVENTOR(S) : OKUDA ET AL.

It is certified that error appears in the above-identified patent and that said Letters Patent is hereby corrected as shown below:

At [57] Abstract

Line 2, "comprising" should read --includes--.
Line 5, "hinge means," should read --rotational center. The gripper portion is adapated; and "The" should read --As a result, the--.
Line 6, "The" should read --As a result, the--.

Column 1

Line 36, "light-weight" should read --lightweight--.
Line 41, "An other" should read --Another--.
Line 58, "5A" should read --5A,--.

Column 2

Line 37, "respect" should read --with respect--.
Line 46, "operator," should read --operator--.
Line 59, "4 one" should read --4 with one--.

Column 3

Line 19, "i.e." should read --i.e.,--.
Line 25, "light-weight" should read --lightweight--.
Line 40, "Cheaper." should read --cheaper.--
Line 47, "portion" should read --portions--.
Line 62, "light weight" should read --lightweight--.

UNITED STATES PATENT AND TRADEMARK OFFICE

CERTIFICATE OF CORRECTION

PATENT NO. : 5,737,667

DATED : April 7, 1998

INVENTOR(S) : OKUDA ET AL.

It is certified that error appears in the above-identified patent and that said Letters Patent is hereby corrected as shown below:

Column 4

Line 9, "embodiment," should read --embodiment--.
Line 11, "portion" should read --portions-- and "is" should read --are--.
Line 12, "portion" should read --portions--.
Line 13, "portion is" should read --portions are--.
Line 33, "portion" should read --portions--.
Line 41, "Qn" should read --on--.
Line 63, "light-weight" should read --lightweight--.

Column 5

Line 10, "light-weight" should read --lightweight--.

Signed and Sealed this

Sixth Day of October, 1998

Bruce Lehman

*Attest:*

BRUCE LEHMAN

*Attesting Officer*

*Commissioner of Patents and Trademarks*